United States Patent [19]

Wilcox

[11] Patent Number: 4,777,903

[45] Date of Patent: Oct. 18, 1988

[54] RESERVOIR WICK SYSTEM

[75] Inventor: Raymond D. Wilcox, Fairport, N.Y.

[73] Assignee: Xerox Corporation, Stamford, Conn.

[21] Appl. No.: 34,251

[22] Filed: Apr. 6, 1987

[51] Int. Cl.[4] ..... G03G 15/20

[52] U.S. Cl. ..... 118/60; 118/101; 118/260; 355/3 FU; 355/14 FU; 432/75

[58] Field of Search ..... 118/60, 101, 260, 267, 118/268; 432/60, 75, 225; 355/3 FU, 14 FU; 219/216, 469, 471

[56] References Cited

U.S. PATENT DOCUMENTS

| | | | |
|---|---|---|---|
| 3,003,461 | 10/1961 | Rosenthal | 118/268 X |
| 3,718,116 | 2/1973 | Thettu | 118/266 |
| 3,745,972 | 7/1973 | Thettu | 118/261 |
| 3,831,553 | 8/1974 | Thettu | 118/266 |
| 3,841,827 | 10/1974 | Thettu | 432/60 |
| 3,918,804 | 11/1975 | Bar-on | 355/3 R |
| 3,937,637 | 7/1973 | Moser et al. | 148/6 |
| 4,083,322 | 4/1978 | Beckman, Jr. | 118/260 X |
| 4,287,280 | 9/1981 | Swift | 118/60 X |
| 4,309,957 | 1/1982 | Swift | 118/60 |
| 4,324,482 | 4/1982 | Szlucha | 432/75 X |
| 4,359,963 | 11/1982 | Saito et al. | 118/60 |
| 4,515,884 | 5/1985 | Field et al. | 118/60 X |
| 4,533,231 | 8/1985 | Shigenobu | 118/60 X |

FOREIGN PATENT DOCUMENTS

| | | | |
|---|---|---|---|
| 52-110049 | 9/1977 | Japan . | |
| 54-37752 | 3/1979 | Japan . | |
| 0165177 | 12/1981 | Japan | 118/60 |

*Primary Examiner*—Shrive Beck
*Assistant Examiner*—Alain Bashore
*Attorney, Agent, or Firm*—Ronald F. Chapuran

[57] ABSTRACT

A reservoir wick system in an apparatus for fixing a toner image on image supporting members including a first and second roller for conveying the image supporting member therebetween and fixing the toner image on the image supporting member, an applicator in contact with the first roller for applying offset preventing liquid to the first roller and forming a nip for receiving said image supporting member, the applicator disposed underneath the first roller and including a woven cloth for retaining the offset preventing liquid, the flow offset prevention liquid to the first roller being drawn up by capillary action and controlled by the weave of the woven cloth.

2 Claims, 2 Drawing Sheets

RESERVOIR WICK SYSTEM

BACKGROUND OF THE INVENTION

This invention relates generally to fusing systems for pressure fixing toners at elevated temperatures in electrostatic copying devices, and more particularly, to improved reservoir wick system for applying release agent to fuser members.

In order to affix or fuse toner material to a support surface permanently by heat, it is necessary to elevate the temperature of the toner material in order that the constituents of the toner material coalesce and become tacky. This action causes the toner to float to some extent into the fibers or pores of support members. Thereafter, as the toner material cools, solidification of the toner material causes the toner material to be firmly bounded to the support member.

Several approaches to thermal fusing of toner images onto a support material have been described in the prior art and include providing the concomitant application of heat and pressure by a roll pair maintained in pressure contact, a flat or curved plate member in pressure contact with a roll, a felt member in pressure contact with a roll, or any other suitable means. The fusing of the toner takes place when the proper combination of heat, pressure and contact time are provided, the balancing of these parameters being well known in the art and varying according to various factors.

During operation of some fusing systems, the support member is moved through the nip formed by a roll pair. By controlling the heat transfer to the toner, virtually no offset of the toner particles from the copy sheet to the fuser member is experienced under normal conditions. This is because the heat applied to the surface of the fuser member is insufficient to raise the temperature of the surface of the member above the "hot offset" temperature of the toner at which temperature the toner particles in the image areas of the toner liquefy and cause a splitting in the molten toner resulting in "hot offset". Splitting occurs when the cohesive force holding the viscous toner mass together is less than the adhesive forces tending to offset it to a contacting surface such as a fuser roll, belt, or plate. Occasionally, toner particles will be offset to the fuser roll by an insufficient application of heat to the surface (cold offsetting), by imperfection in the properties of the surface of the roll, by the toner particles insufficiently adhering to the copy sheet, by the electrostatic forces which normally hold them, or by the reactivity of the toner material itself.

One arrangement for minimizing the foregoing problems, particularly, that which is commonly referred to as offsetting, has been to provide a fuser member with an outer surface to which a release agent such as silicone oil is applied. Various polymer release materials can be used to prevent offsetting, such as disclosed in U.S. Pat. No. 3,937,637 and 3,918,804. The release agent may be applied to the fuser member by means of as described in U.S. Pat. Nos. 3,718,116, 3,831,553, and U.S. Pat. No. 3,841,827.

In using a wick assembly to apply release agent, the wick assembly often includes a felt material for absorbing and retaining the silicone oil by capillary phenomenon. The felt is then brought into into direct contact with the fixing roller or into contact with an applicator roller rotating while being in contact with the fixing roller whereby the silicone oil applied to the fixing roller. In such devices, however, often to much oil is applied and therefore the toner image is stained with oil and when ink is applied to the supporting member, the ink does not spread well. In addition, slippage often occurs between the fixing roller and the pressure roller to disturb the toner image. Also, a greater amount of oil than necessart is uneconomically consumed leading to a high frequency in which the oil supply cartridge is replaced. U.S. Pat. Nos. 3,718,116 and 3,745,972 disclose devices using a two-layer felt to reduce the amount of oil applied. However, in these systems, streak-like application irregularities tend to occur and it is very difficult to uniformly apply a small amount of oil. Another problem is that toner or paper powder or carrier particles often clog the felt whereby application irregularities are caused. In order to compensate for the above-mentioned irregularities, Japanese Laid Open patent application Nos. 110049/1977 and 37752/1979 disclose designs such that the amount of silicone oil applied to the fixing roller is controlled by non-fibrous high molecular synthetic resin having fine continuous pores. However, in the above identified disclosure, it has been confirmed that both high viscosity and low viscosity liquid is controlled by an appropriate amount and uniformly applied in the central area of said synthetic resin material with respect to the lengthwise direction of the roller, while in the opposite end portions thereof, the amount of liquid applied tends to be great. Thus, if the amount of liquid applied to the roller is great at the end portions of the synthetic resin material with respect to the lengthwise direction of the roller, this may result in slippage between the fixing roller and the pressing roller, as well as cause irregularity of the roller covered with silicone rubber, liquid contamination of the toner image supporting member and in addition, a greater amount of liquid than necessary may be uneconomically consumed.

To overcome this difficulty, U.S. Pat. No. 4,359,963 discloses an applicator that has an obstructing member for obstructing the oozing of the offset preventing liquid from the end areas of the contact with respect to the lengthwise direction of the roller. A difficulty with this type of system is that the pore size of a non-fibrous high molecular synthetic resin is not always reliable and flexible to be able to control oil flow. In addition, in the system as described in U.S. Pat. No. 4,359,963, the release agent or silicone oil is disposed above the fuser roll and the force of gravity will cause most of the oil to gather at the lower portion of the wick causing possible oil leakage and greater dispense rates.

SUMMARY OF THE INVENTION

It is an object of the present invention, therefore, to provide a new and improved fixing device to overcome the above-noted difficulties and inconveniences.

It is another object of the present invention to provide a new and improved reservoir wick system wherein the system is disposed underneath the fusing roll and the amount of oil flow is controlled by a woven cloth.

It is still another object of the present invention to provide a new and improved reservoir wick system wherein the control of the oil flow is controlled by changing the weave of a woven cloth.

Further advantages of the present invention will become apparent as the following description proceeds, and the features characterizing the invention will be pointed out with particularity in claims annexed to and forming a part of this specification.

Briefly, the present invention is reservoir wick system in an apparatus for fixing a toner image on image supporting members wherein a first and second roller for conveying the image supporting member therebetween and fixing the toner image on the image supporting member, an applicator in contact with the first roller for applying offset preventing liquid to the first roller and forming a nip for receiving said image supporting member, the applicator disposed underneath the first roller and including a woven cloth for retaining the offset preventing liquid, the flow offset preventing liquid to the first roller being drawn up by capillary action and controlled by the weave of the woven cloth.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENTS

Figure 1:
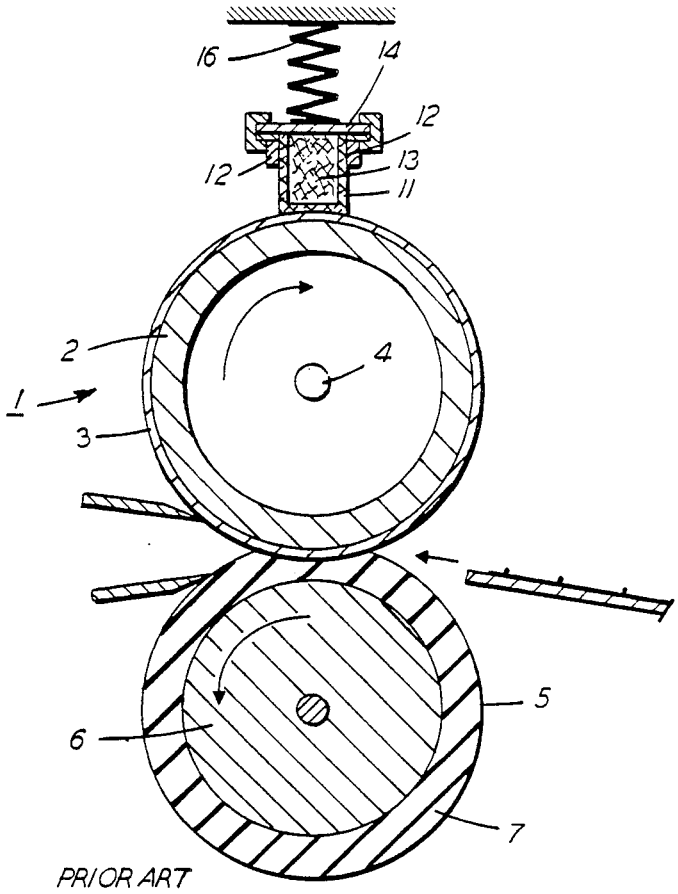
FIG. 1 is a typical prior art reservoir wick system.

With reference to FIG. 1, there is disclosed a typical prior art reservoir wick system including a fixing roller generally shown at 1 comprising a metal hollow pipe 2 with a thin coating 3 of offset preventing material such as silicone rubber. A heater 4 is disclosed in the hollow roller 1 and the peripheral surface of the roller 1 is heated by this heater to a temperature capable of melting and fixing toner. A pressure roll 5 having a mandrel roll 6 covered with a thick coating 7 of offset preventing soft elastic material such as silicone rubber is urged against the fixing roller 1 and elastically deformed to form a nip portion between the pressure roll and the fuser roll. A toner image that adheres to paper is guided into the nip portion.

A reservoir wick system disposed above the fixing roller l includes a synthetic resin film 11 is formed into an elongated shadow bag and fixed to a support frame 12. The bag of the film 11 is filled with heat resisted felt 13 having silicone oil absorbed and retained so that oil is supplied from felt 13 to the film 11. A lid 14 is attached to the frame 12 and the spring force of a spring 16 forces down the lid 14. A thin film of sealant is applied to the inner surface of the film 11 to close the pores at the opposite end portion of the film 11. As illustrated in FIG. 1, the film 11 and felt 13 are located above the fuser roll 1 and the silicone oil is poured or pumped in at the top of the support frame 12 and hollow bag. Through capillary action and gravity, the silicone oil flows down through the felt to the open pores of the film 11. The oil goes through the pores to the fuser roll 1 and sealant is used on the side of the bag preventing oil from leaking out to non-contact areas. Because of gravity, most of the oil will gather at the lower portion of the belt 13 causing possible oil leakage and greater oil dispense rates.

Figure 2:
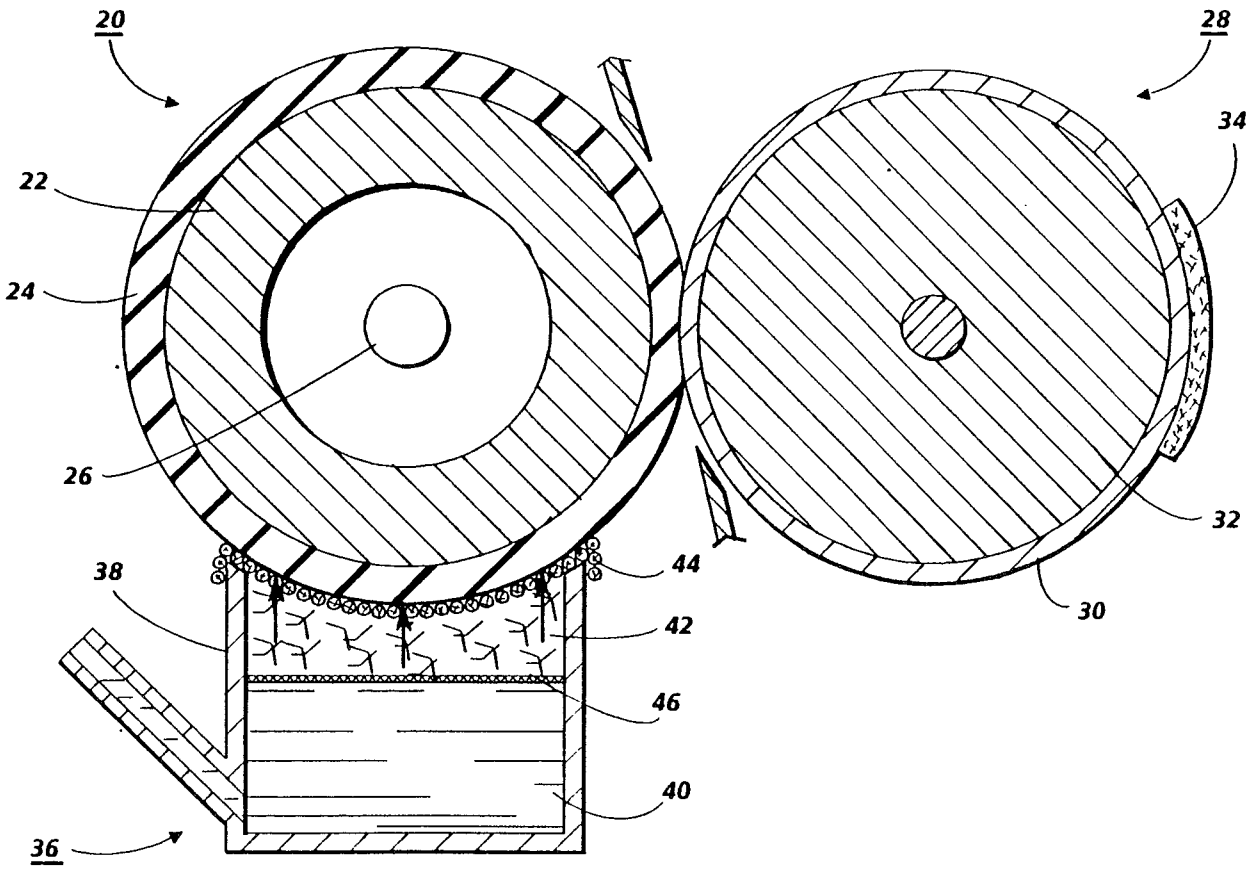
FIG. 2 is a reservoir wick system in accordance with the present invention.

In accordance with the present invention, with reference to FIG. 2, there is disclosed a fuser roll generally illustrated at 20 including an aluminum core 22 supporting an offset preventing material 24 of silicone rubber or any suitable material. A heating lamp 26 is secured in the hollow of the roll 20 and peripheral surface of the fuser roll 20 is heated by the heating lamp 26 to a temperature sufficient to melt and fix toner. A pressure roll generally shown at 28 having a suitable offset preventing coating 30 such as TEFLON type coating coated on a steel core 32 is pressed against the fuser roll 20 and is elastically deformed at the point of contact with the fuser roll 20 to form a nip portion for receiving a toner image supporting member or copy sheet between the pressure roll 28 and the fuser roll 20. One of the pressure or fuser roll is rotatively driven by a motor (not shown) and the other of the rolls is driven or rotated by the friction force with the rotatively driven roller. At the time, a copy sheet is received in the nip portion, a toner image is heat melted and adheres to the copy sheet and is fixed. The copy sheet is guided to the nip by any suitable sheet or paper transport device and having passed through nip, the copy sheet is suitably separated from the rollers by a pawl-like member or members bearing lightly against the rollers. A wiper 34 of NOMEX type material or any other suitable material engages the pressure roll 28.

In accordance with the present invention, the wick reservoir system generally shown at 36 is located underneath the fuser roll 20 and includes an aluminum housing or holder 38, a part of which is a silicone oil reservoir 40 holding a supply of silicone oil. A supply wick 42 of NOMEX type material felt or any other suitable material engages a woven cloth 44 in contact with the surface of the fuser roll 20. The supply wick 42 is separated from the silicone oil reservoir 40 by a metal screen 46.

Silicone oil is drawn up from the reservoir 40 by the supply wick 42 and by capillary action the oil moves through the supply wick 42 to the woven clothe 44 which provides a cover to the aluminum holder 38. Essentially, the oil in the reservoir 40 travels from the reservoir to the roll 20 surface by capillary action which action will only take place if there is a gradient across the supply wick 42. That is, for the oil to flow up, the oil concentration at the upper portions of the wick 42 must be lower than the concentration of oil at the bottom portion of the supply wick 42.

Figure 3:
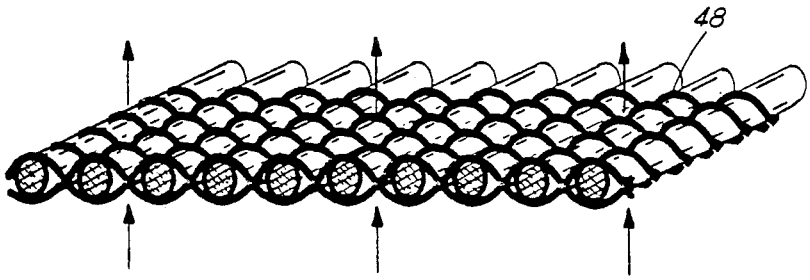
FIG. 3 is an illustration of the control of oil flow in accordance with the present invention.

During operation of the fuser, the rotating fuser roll 20 removes oil. This eventually causes the oil concentration at the upper portion of the wick 42 to decrease, thus starting the flow of oil up by capillary action. This flow continues until the wick reaches equilibrium. Usually equilibrium is not reached during fuser operation but when the fuser is in a standby operation. During the standby operation of the machine, often a puddle of oil is formed between the cover wick and the fuser roll surface. When a fuser roll is activated, this puddle and most of the oil from the upper surface of the cover wick is removed by the first few fused copies in the machine. Then, because the oil moves slowly through the wick, there will be a lapse of time before the oil taken out by the puddle can be replaced. This results in very little oil being dispensed for the remainder of the copy run. Given time in the standby operation, the system will recover, but if its in a constant run mode, it will be difficult for the oil to replenish the upper portion of the wick. In accordance with the present invention, a flow control device is inserted between the wick 42 and fuser roll 20. This flow control device is the woven cloth 44, the woven cloth preferably Nomex, results in making the flow rate of oil to the fuser roll 20 approximately the same as the flow rate by capillary action through the wick assembly. With reference to FIG. 3, the woven cloth includes a weave pattern 48. By changing the weave pattern 48 of the woven cloth 44 (either tighter or loser), it is possible to increase or decrease the oil flow as illustrated by the arrow through the woven cloth to the fuser roll 20. Without such a control device, it has been shown that the fuser roll 20 would remove all the oil at the wick surface within approximately 100 fused copies. This would result in copy sheets or paper sticking to the fuser roll, hot offsetting of the toner, or a premature fuser roll failure.

While there has been illustrated and described what at present considered to be a preferred embodiment of the present invention, it would be appreciated that numerous changes and modifications are likely to occur to those skilled in the art and it is intended in the appended claims to cover all those changes and modifications which fall within the true spirit and scope of the present invention.

I claim:

1. Apparatus for fixing a toner image on a copy sheet comprising:

a first roller and a second roller disposed in contact with the first roller forming a nip for receiving a copy sheet and fixing the toner image on the copy sheet, an applicator in contact with the first roller for applying offset preventing liquid to the first roller, the applicator including:

a reservoir for the offset preventing liquid disposed underneath the first roller, a supply wick, a metal screen disposed intermediate the supply wick and the reservoir, a woven cloth disposed underneath the first roller and communicating with the supply wick, the offset preventing liquid being drawn up through the screen to the supply wick by capillary action and then drawn up through the wick to the woven cloth and applied to the first roller, and means for controlling the flow of the offset preventing liquid to the first roller by changing the weave of the woven cloth.

2. The apparatus of claim 1 wherein the woven cloth is Nomex.

* * * * *